United States Patent [19]

Orwig

[11] Patent Number: 4,579,235

[45] Date of Patent: Apr. 1, 1986

[54] CRANE BOOM STOWING APPARATUS

[75] Inventor: Herbert L. Orwig, Summerville, S.C.

[73] Assignee: Figgie International Inc., Willoughby, Ohio

[21] Appl. No.: 683,807

[22] Filed: Dec. 20, 1984

[51] Int. Cl.[4] ..... B66C 23/62

[52] U.S. Cl. ..... 212/182; 212/229; 212/238

[58] Field of Search ..... 212/175–177, 212/182, 187, 238, 261, 229

[56] References Cited

U.S. PATENT DOCUMENTS

| | | | |
|---|---|---|---|
| 2,025,284 | 12/1935 | Huot | 212/183 |
| 2,157,376 | 5/1939 | Zeilman | 212/182 |
| 2,906,501 | 9/1959 | Brell | 212/229 |
| 3,792,778 | 2/1974 | Sholl et al. | 212/229 |
| 4,039,093 | 8/1977 | Schmitz et al. | 212/229 |
| 4,189,278 | 2/1980 | Dewey | 414/713 |
| 4,491,229 | 1/1985 | Behrendt et al. | 212/177 |

FOREIGN PATENT DOCUMENTS

| | | | |
|---|---|---|---|
| 2228857 | 1/1974 | Fed. Rep. of Germany | 212/175 |
| 2103574 | 2/1983 | United Kingdom | 212/182 |

*Primary Examiner*—Galen L. Barefoot
*Assistant Examiner*—Stephen P. Avila
*Attorney, Agent, or Firm*—Christel, Bean & Linihan

[57] ABSTRACT

A crane boom stowing apparatus utilizes a pair of anchor members attached to the crane frame and a pair of leg members pivotally secured at one end to the crane boom. The leg members are pivotally movable between a boom-stowing condition at which the other ends of the legs are releasably secured to the anchor members and a second condition at which the leg members are positioned generally alongside the boom for releasable securement thereto.

12 Claims, 8 Drawing Figures

Fig. 1.
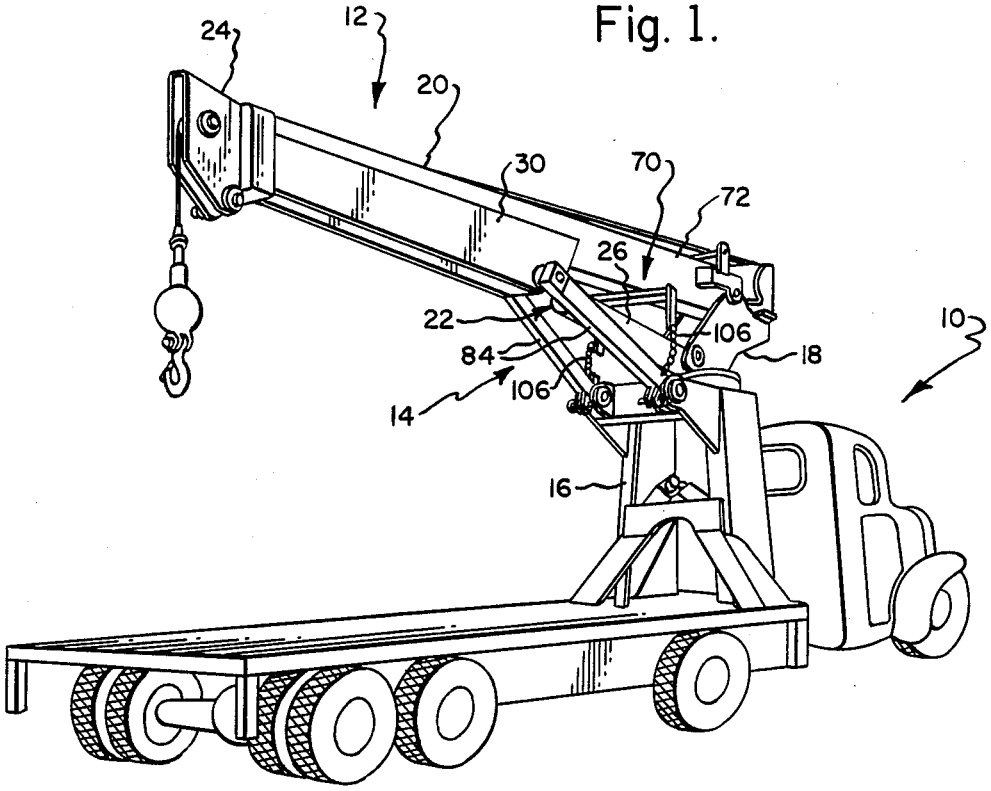
Fig. 6.
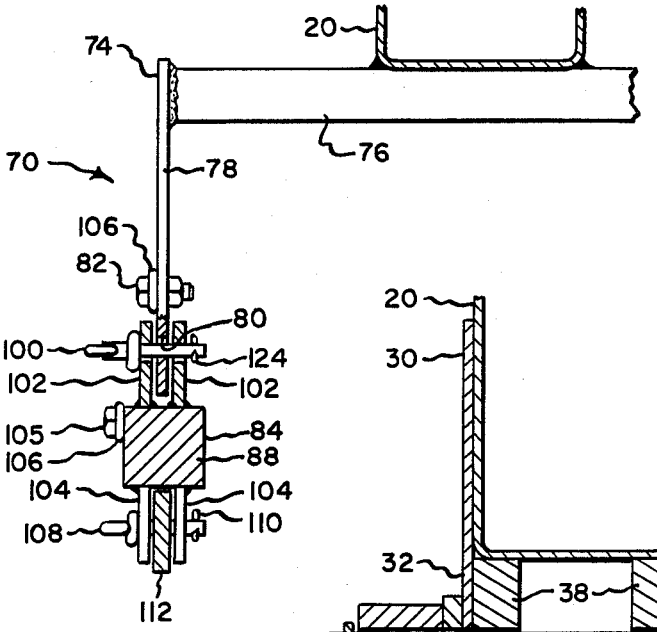
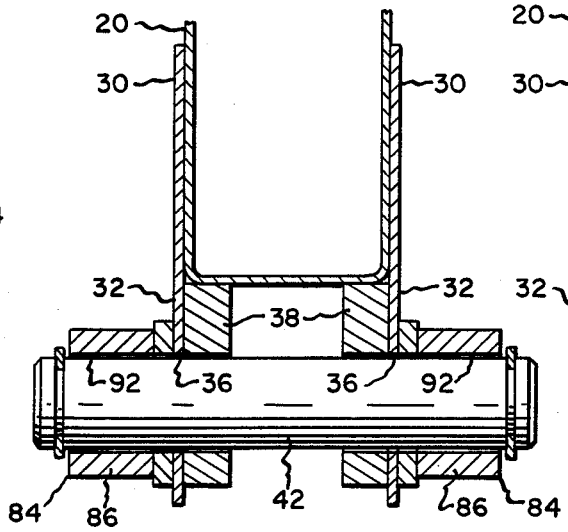
Fig. 7.
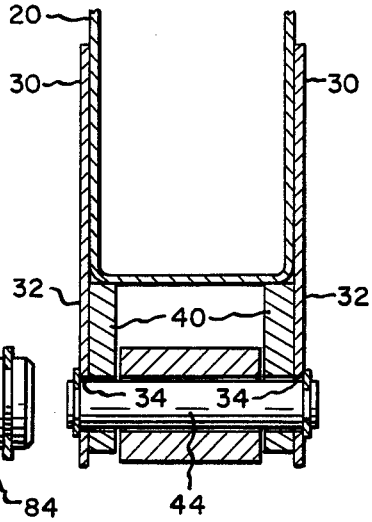
Fig. 8.

CRANE BOOM STOWING APPARATUS

BACKGROUND

This invention relates, generally, to cranes and relates more particularly, to support or stowing apparatus for stowing the boom of a crane in an elevated or raised position.

The type of crane with which this invention is concerned includes a frame, an upwardly-projecting mast rotatably mounted on the frame, and a boom secured to the free end of the mast. Such cranes are commonly mounted on a vehicle such as a semitrailor tractor truck.

The stowing apparatus with which this invention is concerned includes a pair of props or leg members adapted to extend between the crane boom and the crane frame. Extending therebetween, the props support the free end of the boom at a minimum elevation and prevent the boom from swaying from side to side while the crane is being transported. In applications in which the crane is mounted directly behind a truck cab, the stowing apparatus is advantageous in that it consumes no valuable space, for example, on the bed of the truck. Such a stowing apparatus is shown and described in U.S. Pat. No. 3,792,778.

A boom stowing apparatus, such as the one described in the referenced patent, includes no means for preventing the free end of the boom from moving upwardly relative to the crane frame. Instead, such upward movement of the free end of the boom is prevented only by the weight of the boom upon the apparatus props. Upward jarring of the boom, such as may be experienced while the crane is being transported between job sites, could cause the boom to bounce off of the stowing props. Furthermore, such an apparatus requires that its props be manually lifted in order to place the props into or out of a boom-stowing condition. The props of such an apparatus are relatively heavy and can, consequently, be very difficult to lift manually. Still further, props of such an apparatus are stored, when not in use, alongside the crane frame. In applications requiring that the crane boom operator stand alongside the crane frame while manipulating the boom controls, the stored props are likely to be in the operator's way. Yet still further, such an apparatus is relatively complicated in structure and, thus, relatively costly to manufacture.

It is, accordingly, an object of the present invention to provide a new and improved crane boom stowing apparatus which securely locks the boom at an elevated position and thereby prevents the free end of the boom from moving upwardly or downwardly relative to the crane frame.

Another object of the present invention is to provide such a boom support assembly which is easy to use and requires no manual lifting of heavy members when placing the apparatus in a boom-stowing condition or an apparatus-storing condition.

Still another object of the present invention is to provide such a boom support apparatus which is storable in a condition so that it cannot interfere with the manipulations of a crane boom operator.

Yet still another object of the present invention is to provide such a boom support assembly which is uncomplicated in structure and relatively economical to manufacture.

SUMMARY OF THE INVENTION

This invention resides in a crane boom stowing apparatus for a crane having a frame, a mast rotatably mounted on the frame and projecting upwardly therefrom, and a boom secured to the free end of the mast.

The apparatus includes two anchor members fixed to the crane frame and two leg members. The anchor members are attached to the frame so that the mast is disposed generally between the two anchor members and so that the boom is disposed above the anchor members. The leg members are arranged on opposite sides of the boom and each define two opposite ends. One end of each of the legs is releasably securable to a corresponding one of the anchor members, and the other end of each leg member is pivotally connected to the boom so that the leg members can be pivotally moved relative to the boom between a first, or boom-stowing, condition at which each of said one leg member ends can be attached to the anchor members for stowing the boom in an elevated position and a second, or apparatus-storing, condition at which the leg members are positioned generally alongside the boom. The apparatus further includes securement means attached to the boom for releasably securing the leg members in the second condition.

BRIEF DESCRIPTION OF THE DRAWINGS

FIG. 1 is a perspective view of a truck-mounted crane utilizing an embodiment of the apparatus of this invention.

FIG. 6 is a cross-sectional view taken about on line 6—6 of FIG. 4.

FIG. 7 is a cross-sectional view taken about on line 7—7 of FIG. 2.

FIG. 8 is a cross-sectional view taken about on line 8—8 of FIG. 2.

DETAILED DESCRIPTION OF AN ILLUSTRATIVE EMBODIMENT

Figures 2, 3, 4, 5:
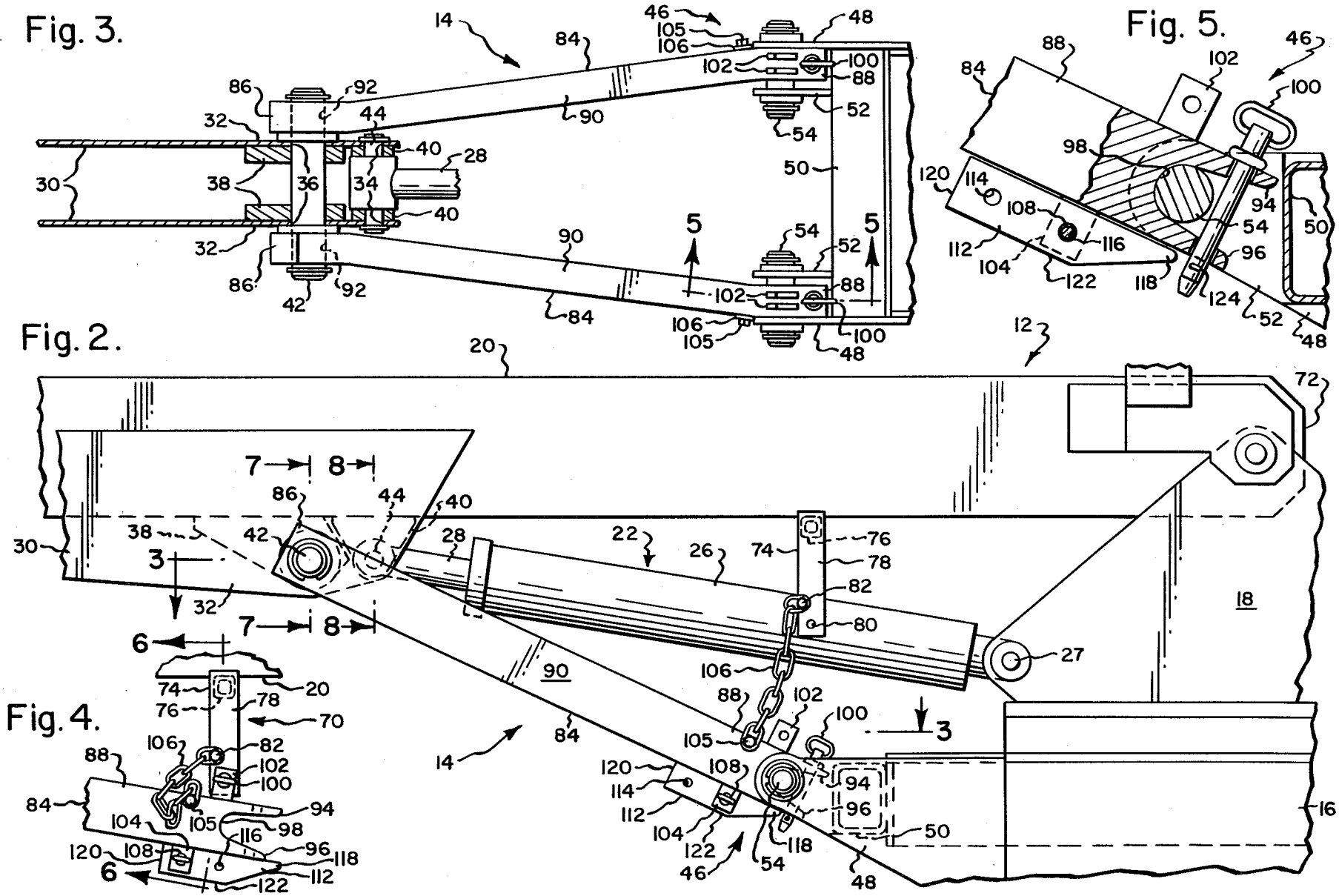
FIG. 2 is an elevation view of a portion of the FIG. 1 crane and apparatus as viewed generally from the right in FIG. 1.
FIG. 3 is a cross-sectional taken about on line 3—3 of FIG. 2.
FIG. 4 is a fragmentary elevation view of the FIG. 1 crane and apparatus illustrating a leg member of the apparatus in a stored condition.
FIG. 5 is a fragmentary elevation view, shown partially in section, of the FIG. 1 crane and apparatus and drawn to a slightly larger scale.

Turning now to the drawings in greater detail and considering first FIG. 1, there is shown a truck 10 having a crane 12 mounted thereon and an embodiment of the boom rest apparatus, generally indicated 14, in accordance with the present invention. The crane 12 includes a frame 16, a mast 18 rotatably mounted on the frame 16 and projecting upwardly therefrom, and a boom 20 secured to the free, or upper, end of the mast 18. As will be described in greater detail hereinafter, the boom rest apparatus 14 acts between the frame 16 and boom 20 to support the boom 20 in a stowed, or elevated, condition.

The crane frame 16 includes a box-like structure for supporting the weight of the boom 20 and any load lifted thereby and is fixedly secured at its lower end to the bed of the truck 10. The mast 18 is mounted upon the frame 16 to permit rotation relative thereto about a substantially vertical axis. The boom 20 is pivotally connected at one end, indicated 72, to the free end of the mast 18 to permit pivotal movement relative thereto about a substantially horizontal axis. It will be understood that the connections between the frame 16 and a mast 18 and between the mast 18 and boom 20 permit the free end 24 of the boom 20 to be moved through a broad range of positions.

With reference to FIGS. 1, 2, 7 and 8, there is shown positioned on opposite sides of the boom 20 and fixedly attached thereto a pair of thin, elongated plates 30,30. The plates 30,30 extend from the free end, indicated 24, of the boom 20 toward the mast 18 and along a substantial portion of the boom length. The plates 30,30 each include a portion, indicated 32, which projects downwardly as shown, and the plate portions 32,32 define two sets of aligned openings 34,34 (FIG. 7) and 36,36 (FIG. 8) at locations adjacent the ends of the plates 30,30 oriented closer to the mast 18.

With reference to FIG. 7, one set of plate openings 34,34 are reinforced with apertured steel platens 38,38 and a large-diametered pivot pin 42 is accepted by the openings 34,34. The pivot pin 42 is of such size that its end portions project a substantial distance away from the sides of the boom 20. With reference to FIG. 8, plate openings 34,34 are reinforced with apertured steel platens 40,40, and another pin 44 is accepted by the openings 34,34. The pin 44 is secured within the openings 34,34 by retaining rings positioned at opposite ends of the pin 44.

Referring again to FIGS. 1 and 2, there is shown a cylinder assembly 22 mounted between the mast 18 and the boom 20 for pivotally moving the boom 20 relative to the mast 18. Thus, by actuating the cylinder assembly 22, the free end 24 of the boom 20 is raised and lowered. The cylinder assembly 22 includes a cylinder 26 and a piston rod 28 slidably movable relative to and along the cylinder 26. The cylinder is pivotally connected to the mast 18 by means of a pivot pin 27, and the piston rod 28 is pivotally attached to the boom 20 by means of the pin 44 secured to the plates 30,30.

With reference to FIGS. 1–3 and in accordance with the present invention, the boom stowing apparatus 14 includes anchor means, generally indicated 46, fixedly attached to the crane frame 16. The anchor means 46 is comprised of an assembly including two planar ear-like pieces 48,48, a cross-member 50 extending between the pieces 48,48, two planar lugs 52,52, and two anchor pins 54,54. The ear-like pieces 48,48 are arranged parallel to one another and are fixedly attached, as by welding, to the side of the frame 16 which generally faces rearwardly of the truck 10. Each end of the cross member 50 is fixed to a corresponding one of the pieces 48,48, and the lugs 52,52 are attached to the bar adjacent the ends thereof so that the lugs 52,52 are arranged parallel to and adjacent the pieces 48,84. A pair of aligned openings are defined in each lug 52 and its adjacent piece 48, and an anchor pin 54 is retained within each pair of defined openings. Each anchor pin 54 is arranged so that its longitudinal axis is oriented perpendicular to its corresponding piece 48 and lug 52. and in alignment with the longitudinal axis of the other anchor pin 54. Both anchor pins 54, 54 are retained within the piece and lug openings by means of retaining rings secured about their ends. It will be understood from the above that the anchor pins 54,54 are situated to one side of frame 16 so that the longitudinal axes of the anchor pins 54,54 are spaced a substantial distance from the rotational axis of the mast 18 and that the mast 18 is disposed generally between the pins 54,54.

With reference again to FIGS. 1 and 2, the apparatus 14 further includes securement means, generally indicated 70, attached to the boom 20 and whose purpose will be apparent hereinafter. The securement means 70 is in the form of a U-shaped bracket 74, secured, as by welding, to the underside of the boom 20 so that the U of the bracket opens generally downwardly as shown. The bracket 74 is secured to a location along the length of the boom 20 which is substantially midway between the pivot pin 44 and the attached end 72 of the boom 20. The bracket 74 includes a crossbar 76 and two elongated pieces 78,78 attached to the end of the crossbar 76 so as to form a U. As best shown in FIG. 1, the crossbar 76 is of such length that its end portions extend a substantial distance away from the sides of the boom 20. Located adjacent the lower end of each elongated piece 78 is defined a central opening 80 whose purpose will be hereinafter set forth, and located slightly above the opening 80 of each piece 78 and offset from the longitudinal axis thereof is defined a second opening through which a bolt 82 is securely retained.

With reference again to FIGS. 1–3, the apparatus 14 includes a pair of leg members 84,84 arranged on opposite sides of the boom 20. Each leg member 84 is elongated in shape and defines two opposite end portions 86 and 88 and a middle portion 90 extending between the end portions 86 and 88. As best shown in FIG. 3, the end and middle portions 86,88 and 90 of each leg member 84 are each substantially straight as viewed along its length and the end portions 86 and 88 are both arranged in relation to the middle portion 90 so that the longitudinal axes of the end portions 86 and 88 form an angle of about eight degrees with the longitudinal axis of the middle portion 90 and are generally parallel to one another. With reference to FIGS. 2 and 5, one end portion 88 of each leg member 84 is bifurcated so as to define two forks 94,96 and a concave-shaped seat 98 defined between the forks 94,96. As shown, the forks 94 and 96 and seat 98 form a U-shaped arrangement which opens in a direction generally along the longitudinal axis of the end portion 88. The seat 98 is adapted to accept a corresponding one of the anchor pins 54,54 when the forks 94,94 are positioned on opposite sides of the corresponding anchor pin 54 as shown in FIGS. 2 and 5. As will be explained in greater detail hereinafter, when the pins 54,54 are accepted by the end portion seats 98,98, the leg members 84,84 are in condition for stowing the boom 20. Each fork 94 or 96 of each leg member end portion 88 defines a through-opening which aligns with the through-opening in the other fork 96 or 94 for receiving a drawbar pin 100. As shown in FIG. 2, the drawbar pin 100 is releasably retained with the fork through-openings by means of a key 101. Thus, by placing the end portion seats 98,98 into stowing engagement with the anchor pins 54,54 and placing the drawbar pins 100,100 through the fork through-openings, the leg members end portions 88,88 are securely locked to the frame 16.

Referring still to FIGS. 2 and 5, the end portion 88 of each leg member 84 includes a pair of parallel lugs 102 extending from one side of the end portion 88. As shown, the pair of lugs 102 are directedly generally upwardly. The lugs in the pair 102 define aligned openings for accepting the drawbar pin 100 and are spaced from one another to accept the lower end of a corresponding one of the elongated pieces 78,78 therebetween for a reason which will hereinafter be set forth.

The middle portion 90 of each leg member 84 defines an opening adjacent one side thereof, or the upper side as shown in FIGS. 2 and 5, through which a bolt 105 is received. Attached between each bolt 105 and a corresponding bolt 82 attached to the U-shaped bracket 74 is a chain 106. Each chain 106 is of such length that when the leg member end portion 88 is positioned in its stowing condition of FIGS. 2 and 5 and the boom 20 is oriented substantially horizontal, the chain 106 is relatively taut.

The middle portion 90 of each leg member 84 further includes a pair of parallel lugs 104 located adjacent the end portion 88 and extending from one side thereof. As shown in FIGS. 2 and 5, the pair of lugs 104 are directed generally downwardly. The lugs in the pair 104 define aligned openings for accepting a second drawbar pin 108. As best shown in FIG. 6, the drawbar pin 108 is releasably retained within the openings of the lugs 104 by means of a key 110.

With reference to FIGS. 2, 4 and 5 a thin, skate member 112 is attached between each pair of lugs 104. Each skate member 112 is elongated in shape and defines a pointed front end 118, a blunt back end 120, and a lower casing surface 122, as shown. Each skate member 112 is arranged in relationship to a corresponding leg member end portion 88 so that its longitudinal axis is generally parallel to the longitudinal axis of the end portion 88. Two openings 114,116 (FIG. 5) are defined in each skate member 112, and each of the openings 114 or 116 can be aligned with the openings 104 for receiving the drawbar pin 108. Thus, the openings 114,116 accommodate the positioning of the skate member 112 at either of two positions. More specifically, by aligning the skate member opening 114 with the openings in lugs 104, the skate member 112 and be secured in a forwardmost position characterized by the extending of the skate member front end 118 beyond the end of the bifurcation fork 96, as shown in FIG. 4. Similarly, by aligning the skate member opening 114 with the openings in the lugs 104, the skate member 112 can be secured in a rearwardmost position, as shown in FIGS. 2 and 5. In the rearwardmost position, the front end 118 of the skate member 112 clears the through-opening in the bifurcation fork 96 to permit the drawbar pin 100 to pass therethrough.

With reference to FIG. 7, the other end portion 86 of each leg member 84 defines a through-opening 92 and is attached to the boom 20 by means of a pivot pin 42. More specifically, each leg member end portion 86 is positioned adjacent a corresponding plate 30 and a corresponding end portion of the pivot pin 42 extends through its throughopening 92. The leg member end portions 86,86 are prevented from separating from the pivot pin 42 by means of a retaining ring secured about each end of the pivot pin 42.

In accordance with this invention, the leg members 84,84 are permitted to pivot about the pivot pin 42 and relative to the boom 20 between a boom-stowing condition, as best shown in FIGS. 1 and 2, at which the anchor pins 54,54 are accepted by the end portion seats 98,98 and an apparatus-stowing condition, as best shown in FIG. 6, at which the leg members 84,84 are positioned generally alongside the boom 20. It will be understood, however, that since the leg members 84,84 are rigid and of such length that when the leg members 84,84 are positioned in the boom-stowing condition, the boom 20 is oriented substantially horizontal. Thus, the leg members 84,84 can only be placed in the boom-stowing condition when the boom 20 is oriented substantially horizontal.

With reference again to FIG. 6, the pair of lugs 102 of the leg member end portions 88,88 are adapted to straddle the lower end of a corresponding piece 78 of the U-shaped bracket 74 so that the openings of lugs 102 align with the piece opening 80 when the leg members 84,84 are positioned in the apparatus-storing condition. Thus, the leg members 84,84 can be secured in the apparatus-storing condition by inserting the drawbar pin 100 through the aligned openings of the lugs 102 and piece 78.

To move the leg members 84,84 between the FIG. 2 boom-stowing condition to the FIG. 6 apparatus-storing condition, the following steps are performed. The keys 101,101 are initially removed from the drawbar pins 100,100, and the drawbar pins 100,100 are removed from the forks 94,96 of the leg member end portions 88,88. The free end 24 of the boom 20 is then raised by actuating the crane cylinder assembly 22. As the boom 20 is raised, the seat 98 of each end portion 88 moves relative to its corresponding anchor pin 54 so that the end portions 88,88 move endwise away from the anchor pins 54,54. Because the leg end portions 88,88 are supported by the chains 106,106, there is no danger that the leg members 84,84 will fall as the end portions 88,88 move away from the anchor pins 54,54. The boom 20 is raised until the leg member end portions 88,88 are positioned a few inches above the anchor pins 54,54 and at that point, the cylinder assembly 22 is deactuated. The skate members 112,112 are then moved to the forwardmost position by removing the drawbar pin 108 from each pair of lugs 104, aligning the opening 114 of each skate member 112 with the openings in the lugs 104, and replacing the drawbar pin 108 within the lugs 104. The drawbar pins 108,108 can be prevented from falling out of the lugs 104,104 by means of hitch pins 124 (FIG. 6).

The crane cylinder assembly 22 is then actuated to lower the free end 24 of the boom 20. As the boom 20 is lowered, the front end 118 of each skate member 112 comes into contact with the upper surface of a corresponding anchor pin 54 and slides therealong as the skate member 112 slides rearwardly along the anchor pin 54. As the boom 20 is lowered further, the distance between the leg member end portions 88,88 and the bracket pieces 78,78 decreases. When the openings of the lugs 102 of each end portion 88 align with the opening 80 of the corresponding bracket piece 78, the cylinder assembly 22 is deactuated and the drawbar pin is inserted through the lugs 102. The key 101 is then replaced in the drawbar pin 100. The apparatus 14 is thereby stored to permit desired use of the boom 20.

The apparatus 14 is advantageous in that no manual lifting of heavy members is required to place the apparatus in a stored condition. Furthermore, because the leg members 84,84 are stored alongside the boom 20 in the apparatus-stowing condition, the leg members 84,84 cannot interfere with a boom operator who may be required to stand beside the crane from 16 while manipulating the boom controls.

To move the leg members 84,84 between the FIG. 6 apparatus-storing condition to the FIG. 2 boom-stowing condition, the following steps are performed. The free end 24 of the boom 20 is initially lowered by actuating the cylinder assembly 22 to bring the camming surface 122,122 of the skate members 112,112 into contact with the upper surface of the anchor pin 54,54. It will be understood that the region of each skate member 112, camming surface 122 which makes initial contact with the anchor pin 54 when lowered in this manner is located adjacent the skate back end 120. Once the skate members 112,112 engage the anchor pins 54,54, the cylinder assembly 22 is deactuated, the keys 101,101 are removed from the drawbar pins 100,100, and the drawbar pins 100,100 are removed from the lugs 102. The boom free end 24 is then raised by actuating the cylinder assembly 22 as the skate members 112,112 slide, or are guided, rearwardly along the anchor pins 54,54. The boom 20 is raised until the skate members 112,112 slide off the anchor pins 54,54 and the end portions 88,88 are positioned a few inches above the anchor pins 54,54. At that point, the cylinder assembly 22 is deactuated. The skate members 112,112 are then moved to to the rearwardmost position by removing the drawbar pins 108,108 from the lugs 104,104, aligning the skate opening 116,116 with the openings in the lugs 104,104, and replacing the drawbar pins 108,108 within the lugs 104,104. The drawbar pins 108,108 can then be secured with hitch pins.

The crane cylinder assembly 22 is then actuated to lower the free end 24 of the boom 20. As the boom 20 is lowered, the end portions 88,88 move endwise toward the anchor pins 54,54. The forks 94,96 of each end portion move relative to the corresponding anchor pin 54 until the anchor pin 54 is accepted by the seat 98. At that point, the cylinder assembly 22 is deactuated and the drawbar pins 100, 100 are placed in the through-openings of the forks 94,96 of the end portions 88,88. The drawbar pins 100,100 are then secured in place with the keys 101,101. The boom 20 is thereby stowed in an elevated, or horizontal, position and prevented from swaying from side to side during transport by the apparatus 14.

It will be understood from the above that because each leg member 84 is locked at each of its end portions 86,88 while in a boom-stowing condition, the free end 24 of the boom 20 is prevented from moving upwardly or downwardly when stowed. Thus, upward jarring of the boom, such as may be experience while the crane is being transported between job sites, cannot move the boom 20 out of its stowed position.

It will be understood from the above that numerous modifications and substitutions can be had to the aforedescribed embodiment without departing from the spirit of the invention. For example, although the end portion 86 of each leg member 84 has been described as defining an opening 92 for securement to the pivot pin 42, the end portion 86 can be provided with a bifurcated configuration like that of its opposite leg member end portion 88 and releasably secured to the pivot pin 42 by means of a drawbar pin extending through aligned openings in the bifurcation forks. This latter-described embodiment is advantageous in that it permits each leg member of the boom-stowing apparatus to be completely removed from the boom for storage or use with another crane. Accordingly, the aforedescribed embodiment is intended for purposes of illustration and not as limitation.

I claim:

1. Crane boom stowing apparatus for a crane having a frame, a mast rotatably mounted on the frame and projecting upwardly therefrom, and a boom pivotally secured to the free end of the mast about a horizontal axis of pivot so that the free end of the boom can be raised and lowered as the boom pivots relative to the mast, said apparatus comprising:

two anchor members mounted on the frame so as to be positioned generally below the secured end of the boom and on opposite sides of the mast and each including an anchor pin fixedly secured to the frame;

two rigid leg members being arranged on opposite sides of the boom and each having two opposite end portions, one end portion of each of said leg members being bifurcated so as to define a U-shaped seat adapted to accept a corresponding one of said anchor pins, the other end portion of each of said leg members being pivotally connected to the boom so that each of said leg members can be pivotally moved relative to said boom between a first condition at which said leg members extend angularly downwardly from said boom and a second condition at which said leg members are positioned generally alongside the boom, the bifurcation of each of said one leg member end portions being cooperable with a corresponding one of said anchor pins so that the U-shaped seats are guidable into and out of seating engagement with said anchor pins as the free end of the boom is lowered into and raised from an elevated position and said leg members are positioned in said first condition, each of said one leg member end portions being releasably securable to an anchor pin when its U-shaped seat is in seating engagement therewith for stowing the boom in said elevated position;

means for releasably securing said leg members in said first and second conditions and preventing the free end of the boom from moving upwardly and downwardly relative to the crane frame when the boom is stowed;

tension means connected between the boom and said leg members for suspending said leg members in said first condition; and skate means including elongated skate members connectable to said one leg member end portions so as to be positioned generally between the openings of said U-shaped seats and said anchor pins and slidably engageable with said anchor pins so that when said leg members are positioned in said first condition and the free end of the boom is lowered so that said U-shaped seats of said one leg member end portions approach said anchor pins, said skate members slidably engage said anchor pins and prevent the U-shaped seats from moving into seating engagement with said anchor pins whereby said leg members can be selectively guided into seating engagement with said anchor pins for stowing the boom in said elevated condition or moved into said second condition for storage of said leg members as said skate means slide across said anchor pins.

2. Apparatus as defined in claim 1 wherein the crane mast is rotatable relative to the frame about an axis of rotation and said anchor members are arranged in such relationship to the frame that said anchor members can be connected by an imaginary line drawn therebetween and spaced from the axis of rototion.

3. Apparatus as defined in claim 2 wherein said anchor members are positioned equidistant from the boom.

4. Apparatus as defined in claim 1 wherein said tension means are adapted to limit the angular displacement of said one leg member end portions relative to the boom as said leg members are moved from said second condition to said first condition to about the angle defined between the boom and each leg member when said leg members are positioned in said first condition.

5. Apparatus as defined in claim 1 wherein said means for releasably securing includes means attached to the boom to which said leg members can be securely attached when in said second condition.

6. Apparatus as defined in claim 1 further comprising means for releasably locking including two drawbar pins which are each releasably securable between the bifurcation forks of a corresponding one of said one leg member end portions for securing said one leg member end portions in seating engagement with said anchor pins.

7. Apparatus as defined in claim 6 wherein the bifurcation forks define a pair of aligned openings adjacent the ends thereof and said drawbar pin is receivable by each pair of aligned openings so that when each of said anchor pins are received by the space between a corresponding pair of bifurcation forks and each of said drawbar pins are received by a corresponding pair of said aligned openings, said one leg member end portions are prevented from separating from said anchor pins.

8. Apparatus as defined in claim 7 wherein said one leg member end portions are elongated and the forks of each of said one leg member end portions are arranged so that the forks open in a direction generally along the longitudinal axis of its corresponding one leg member end portion.

9. Apparatus as defined in claim 1 wherein each of said one leg member end portions includes lug means defining an opening therethrough and said securement means includes means cooperating with said lug means for releasably securing said leg members in said second condition.

10. Apparatus as defined in claim 9 wherein said securement means includes a pair of securement pins and a U-shaped bracket fixedly attached to the boom in such a manner that the U of said bracket opens generally downwardly and the longitudinal axis of the boom is disposed between the legs of the U, each leg of the U-shaped bracket defining an aperture for aligning with the opening in said lug means when said leg member is positioned in said second condition, and a corresponding pair of the aligned lug means and bracket openings for releasably securing said leg members to said bracket.

11. Apparatus defined in claim 1 wherein said tension means includes a chain.

12. In combination:

a crane including a frame, an upwardly projecting mast rotatably mounted on the frame, and a boom pivotally secured to the free end of the mast so that the free end of the boom can be raised and lowered as the boom pivots relative to the mast;

two anchor members mounted on said frame and each including an anchor pin fixedly secured to the frame so as to be positioned generally below said boom and on opposite sides of said mast;

two rigid leg members being arranged on opposite said sides of said boom and each having two opposite end portions, one end portion of each of said leg members being bifurcated so as to define a U-shaped seat adapted to accept a corresponding one of said anchor pins, the other end portion of each of said leg members being pivotally connected to said boom so that each of said leg members can be pivotally moved relative to said boom between a first condition at which said leg members extend angularly downwardly from said boom and a second condition at which said leg members are positioned generally alongside said boom for storage of said leg members, the bifurcation of each of said one leg member end portions being cooperable with a corresponding one of said anchor pins so that when said leg members are positioned in said first condition and the free end of the boom is lowered into and raised from an elevated position, the U-shaped seats are guidable into and out of seating engagement with the anchor pins, each of said one leg member end portions being releasably securable to an anchor pin when its U-shaped seat is in seating engagement therewith for stowing the boom in said elevated position;

means for releasably securing said one leg members in said first and second conditions and preventing the free end of said boom from moving upwardly and downwardly relative to said frame when the boom is stowed;

tension means connected between said boom and said leg members for suspending said leg members when in said first condition; and skate means including two elongated members connectable to said one leg member end portion portions so as to be positioned generally between the openings of the U-shaped seats and said anchor pins and slidably engageable with said anchor pins so that when said leg members are positioned in said first condition and the free end of the boom is lowered so that said U-shaped seats of said one leg member end portions approach said anchor pins, said skate members slidably engage said anchor pins and prevent said U-shaped seats from moving into seating engagement with said anchor pins whereby said leg members can be selectively guided into seating engagement with said anchor pins for stowing the boom in said elavated condition or moved into said second condition for storage of said leg members as said skate means slide across said anchor pins.

* * * * *